US009303433B2

(12) United States Patent
Chiou et al.

(10) Patent No.: US 9,303,433 B2
(45) Date of Patent: Apr. 5, 2016

(54) TRANSMISSION MECHANISM OF A LOCK ASSEMBLY

(71) Applicant: Tong Lung Metal Industry Co., Ltd., Chia-Yi (TW)

(72) Inventors: Ming-Shyang Chiou, Chai-Yi (TW); Chia-Min Sun, Chai-Yi (TW); Yu-Ting Huang, Chai-Yi (TW)

(73) Assignee: TONG LUNG METAL INDUSTRY CO., LTD., Chia-Yi (TW)

( * ) Notice: Subject to any disclaimer, the term of this patent is extended or adjusted under 35 U.S.C. 154(b) by 389 days.

(21) Appl. No.: 13/957,434

(22) Filed: Aug. 2, 2013

(65) Prior Publication Data

US 2014/0041422 A1 Feb. 13, 2014

(30) Foreign Application Priority Data

Aug. 7, 2012 (TW) ..... 101215136 U
Sep. 21, 2012 (TW) ..... 101218347 U

(51) Int. Cl.
*E05B 49/00* (2006.01)
*E05B 47/06* (2006.01)
*E05B 47/00* (2006.01)

(52) U.S. Cl.
CPC ..... *E05B 49/00* (2013.01); *E05B 47/068* (2013.01); *E05B 47/0012* (2013.01); *E05B 2047/0084* (2013.01); *Y10T 70/7068* (2015.04); *Y10T 292/1021* (2015.04)

(58) Field of Classification Search
CPC ..... Y10T 292/1021; Y10T 70/7102; Y10T 70/5416; Y10T 70/7068; Y10T 70/7107; Y10T 292/57; Y10T 70/5827; Y10T 70/7136; Y10T 70/7051; Y10T 70/5819; Y10T 70/5823; Y10T 70/7147; Y10T 74/8696
USPC ..... 70/278.1–278.3, 278.7, 279.1, 283, 70/283.1, 284, 285, 222, 223
See application file for complete search history.

(56) References Cited

U.S. PATENT DOCUMENTS 4,956,984 A * 9/1990 Chi-Cheng ..... E05B 47/068 70/277
4,967,305 A * 10/1990 Murrer ..... E05B 47/068 340/5.54
5,014,030 A * 5/1991 Aston ..... E05B 47/0661 192/93 A
5,018,375 A * 5/1991 Tully ..... E05B 47/068 292/144
5,058,404 A * 10/1991 Fish ..... E05B 37/16 70/278.1
5,083,122 A * 1/1992 Clark ..... E05B 47/0012 340/5.22
5,184,491 A * 2/1993 Schittenhelm ..... E05B 37/08 70/278.1
5,421,178 A * 6/1995 Hamel ..... E05B 47/0661 292/144
5,694,798 A * 12/1997 Nunez ..... E05B 47/0661 70/224
6,967,562 B2 * 11/2005 Menard ..... E05B 45/06 292/346
7,516,633 B1 * 4/2009 Chang ..... E05B 13/101 292/251.5

(Continued)

*Primary Examiner* — Suzanne Barrett
(74) *Attorney, Agent, or Firm* — Chun-Ming Shih

(57) ABSTRACT

A transmission mechanism of a lock assembly includes a base; a core assembly partially received in the base and having therein a core adapted to connect to the rod so as to control movement of the rod; an operating element rotatably connected to the base; a clutch device movably received in the base and selectively engaged with the operating element; a driving device received in the core assembly to drive the clutch device to move toward/away from the operating element; and an activation device connected to the base to control operation of the driving device such that the latch is moved with assistance of the rotation of the operating element when the clutch device is connected to the operating element and the latch is immovable when the clutch device is away from engagement with the operating element.

21 Claims, 9 Drawing Sheets

(56) References Cited

U.S. PATENT DOCUMENTS

| | | | | |
|---|---|---|---|---|
| 7,918,114 | B2 * | 4/2011 | Walsh | E05B 47/0661 70/223 |
| 8,141,400 | B2 * | 3/2012 | Sorensen | E05B 47/068 340/5.54 |
| 8,220,299 | B2 * | 7/2012 | Velandi | E05B 47/0012 70/277 |
| 8,356,499 | B2 * | 1/2013 | Peng | E05B 47/068 70/224 |
| 8,887,542 | B2 * | 11/2014 | Bogdanov | E05B 47/0692 464/57 |
| 2003/0160681 | A1 * | 8/2003 | Menard | E05B 45/06 340/5.64 |
| 2004/0040352 | A1 * | 3/2004 | Yu | E05B 47/068 70/107 |
| 2004/0040353 | A1 * | 3/2004 | Yu | E05B 47/068 70/107 |
| 2007/0137267 | A1 * | 6/2007 | Pilatowicz | E05B 47/068 70/107 |
| 2009/0211319 | A1 * | 8/2009 | McCormack | E05B 47/068 70/263 |
| 2013/0031940 | A1 * | 2/2013 | Romero | E05B 37/00 70/278.1 |
| 2013/0167598 | A1 * | 7/2013 | Huang | E05B 47/0012 70/278.1 |
| 2013/0192317 | A1 * | 8/2013 | McKibben | E05B 47/0001 70/278.1 |

* cited by examiner

TRANSMISSION MECHANISM OF A LOCK ASSEMBLY

BACKGROUND OF THE INVENTION

1. Field of the Invention

This invention is related to a transmission mechanism, and more particularly, to a lock assembly transmission mechanism having therein a clutch device with which a ledge is selectively received in a compartment to allow an operating element to drive a latch so as to accomplish the purpose of locking and unlocking the door.

2. Description of Related Art

Normally, activation and deactivation of an electrical lock assembly is based on the driving of a worm shaft driven by a motor. The rotation of the worm shaft then drives a plurality of gears of different sizes to accomplish the purpose of reducing the motor speed and altering the output direction of the motor spindle. Due to the provision of multiple gears, the manufacture cost of such an electrical lock assembly is high and the power consumption by the motor is large. Consequently, lifespan of the battery pack providing the necessary power for activating the electrical lock assembly is reduced.

SUMMARY OF THE INVENTION

One aspect of a preferred embodiment of the present invention is to provide a transmission mechanism of an electrical lock assembly to move the latch in a predetermined pattern.

Another aspect of the preferred embodiment of the present invention is that the electrical lock assembly has a driving means securely installed inside a core assembly to providing force to move the latch. The transmission mechanism of a lock assembly having a rod operably connected to a latch to control movement of the latch comprises: a base; a core assembly partially received in the base and having therein a core adapted to connect to the rod so as to control movement of the rod; an operating element rotatably connected to the base; a clutch device movably received in the base and selectively engaged with the operating element; a driving device (or a motor) received in the core assembly to drive the clutch device to move toward/away from the operating element; and an activation device connected to the base to control operation of the driving device such that the latch is moved with assistance of the rotation of the operating element when the clutch device is connected to the operating element and the latch is immovable when the clutch device is away from engagement with the operating element.

Furthermore, the activation device is able to automatically drive the driving device to cause the clutch device to disengage from the operating element after a predetermined time that the clutch device engages with the operating element.

BRIEF DESCRIPTION OF THE DRAWINGS

The preferred embodiment(s) of the invention, as well as its many advantages, may be further understood by the following detailed description and accompanying drawings.

DETAILED DESCRIPTION OF THE INVENTION

Figure 1:
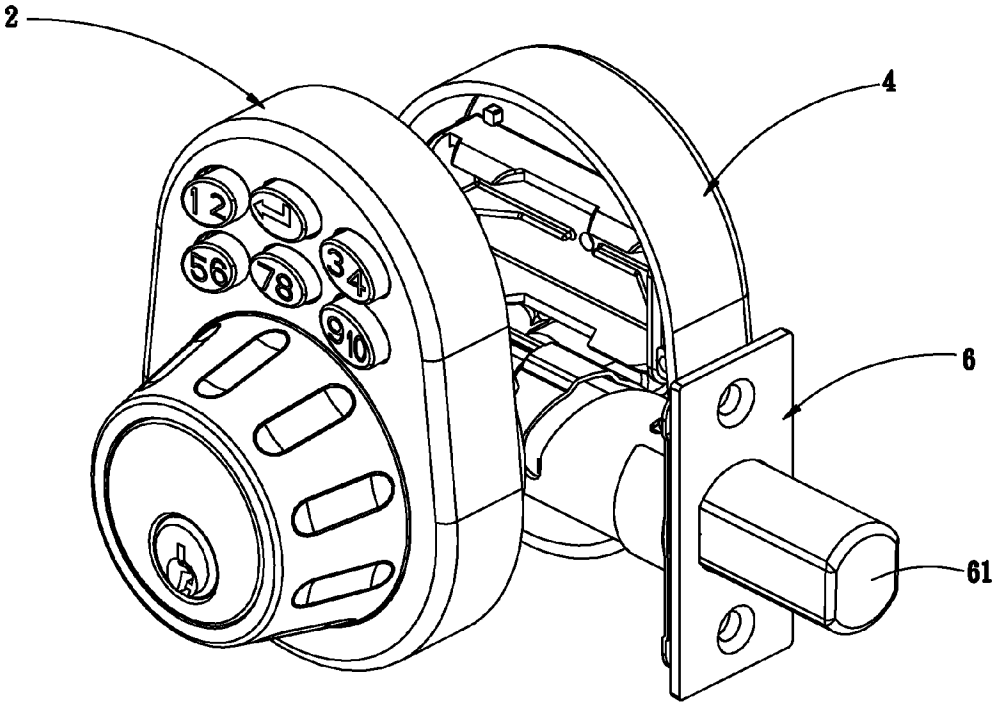
FIG. 1 is a perspective view showing the outer appearance of an electrical lock constructed in accordance with the present invention.

With reference to FIG. 1, the transmission mechanism constructed in accordance with the preferred embodiment of the present invention includes a first lock body 2, a second lock body 4 and a latch device 6 having a latch 61 selectively extendable relative to the first lock body 2 and the second lock body 4.

Figure 2:
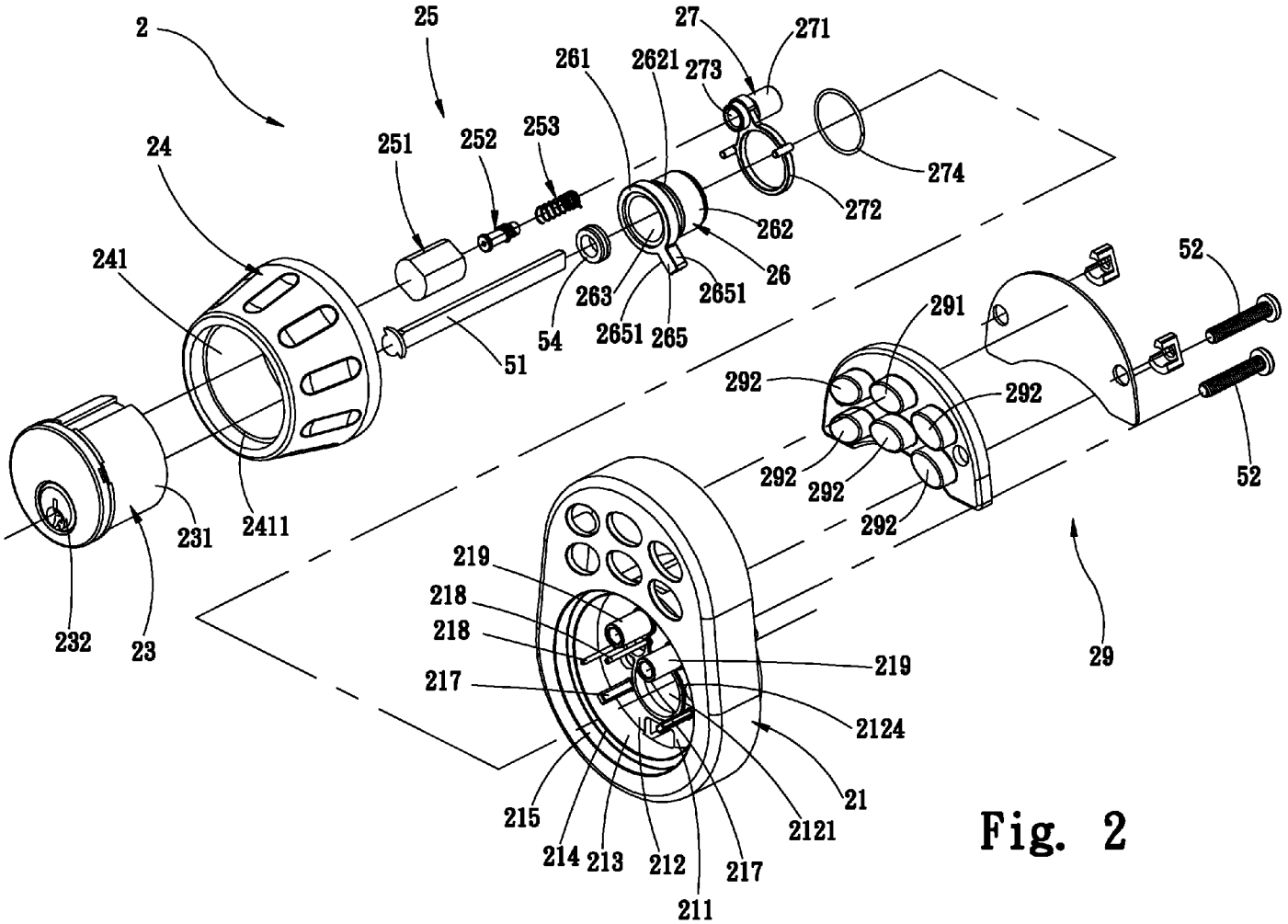
FIG. 2 is an exploded perspective view showing elements of the first lock body of the transmission mechanism of the preferred embodiment of the present invention.
Figure 3:
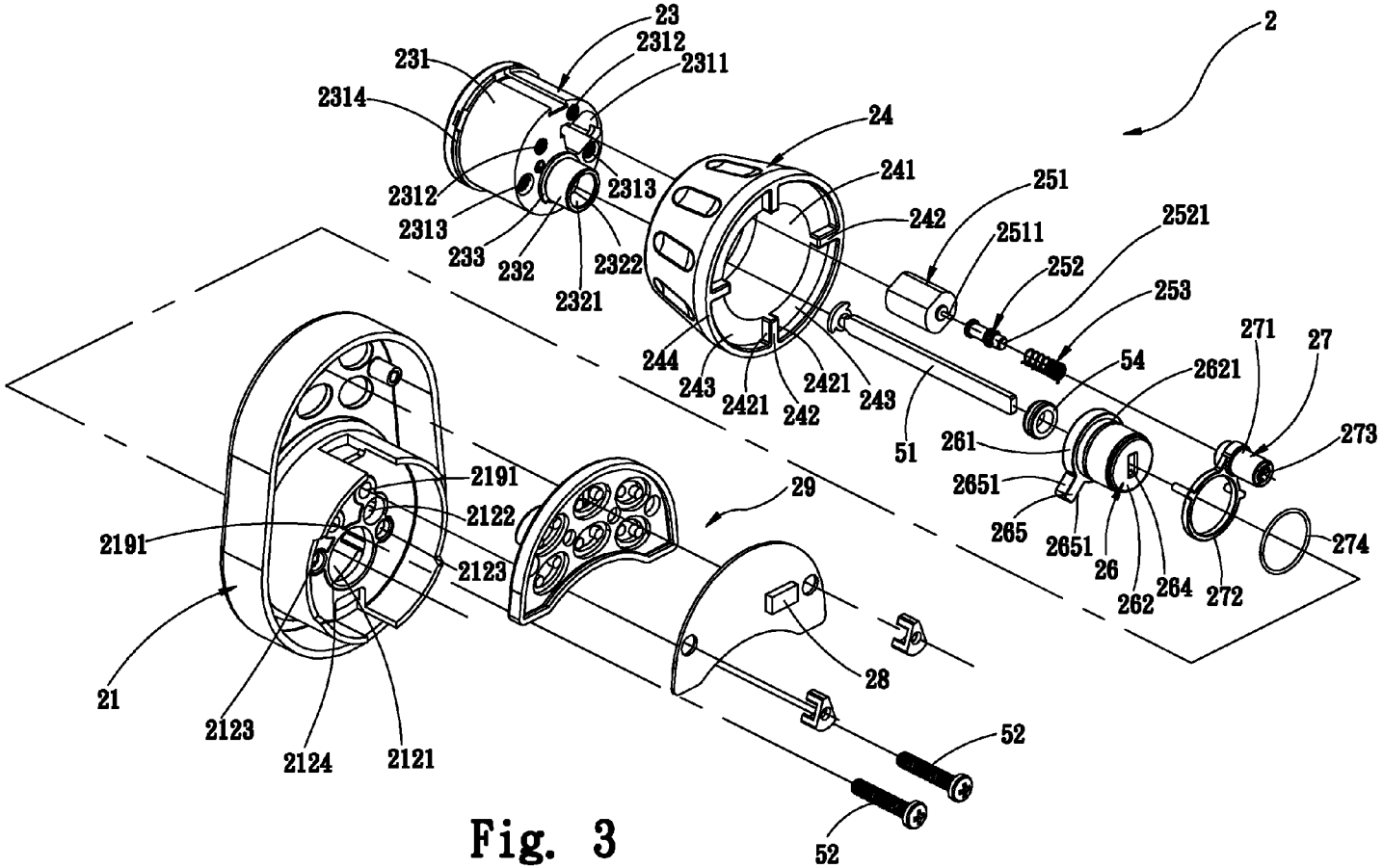
FIG. 3 is still an exploded perspective view showing the elements of the first lock body of the transmission mechanism of the preferred embodiment from an angle different from that of FIG. 2.

With reference to FIGS. 2 and 3, the first lock body 2 constructed in accordance with the preferred embodiment of the present invention includes a base 21, a core assembly 23 securely received inside the base 21, an operating element 24 connected to the base 21 and rotatable relative to the base 21, a driving device 25 securely received in the core assembly 23, a transmission element 27 connected to the driving device 25, a clutch device 26 connected to the transmission element 27 and movable relative to the operating element 24 as a result of the driving from the driving device 25 and an input device 29 securely mounted on a side of the base 21.

The base 21 is constructed to have a compartment 211 defined therein and composed of a base plate 212, a first annular ring 213 formed surrounding the base plate 212, a skirt 214 connects to an edge of the first annular ring 213 and a second annular ring 215 connects to an outer edge of the skirt 214 and having a height difference with the first annular ring 213 as well as the skirt 214, a pair of first supports 217 firmly formed on the base plate 212, a pair of second supports 218 firmly formed on the base plate 212 and a pair of support rods 219 firmly formed on the base plate 212 and respectively provided with a support rod hole 2191 (FIG. 3) centrally defined therein. In addition to the above mentioned elements, the base plate 212 has a base plate first hole 2121, a base plate second hole 2122, a base plate third hole 2123 and an annular wall 2124 formed along a peripheral edge defining the base plate first hole 2121

Figure 7:
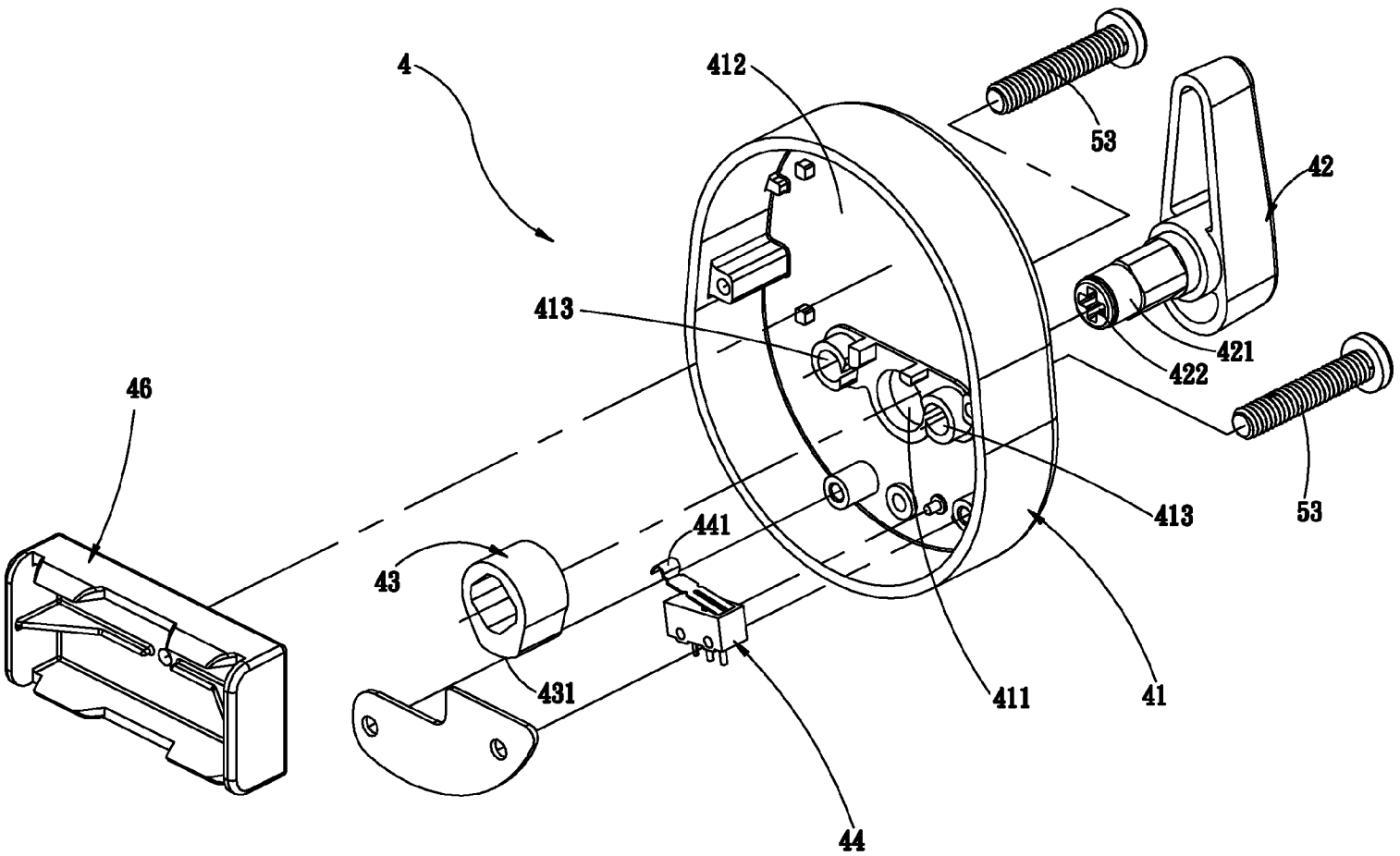
FIG. 7 is an exploded perspective view showing elements of the second lock body of the transmission mechanism of the preferred embodiment of the present invention.
Figure 8:
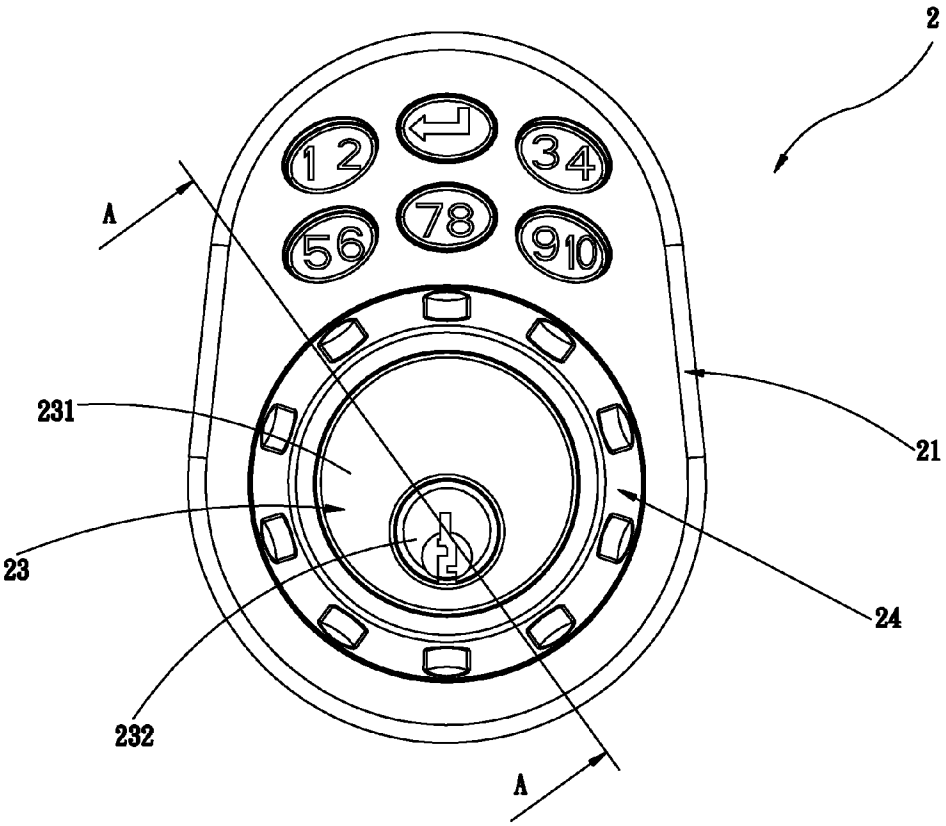
FIG. 8 is a plan side view showing the mating among elements of the operating element, the core assembly and the base.

The input device 29 is provided on a side face of the base 21 and electrically connected to a control unit 28 to process signals sent by a switch 44 (as shown in FIG. 7). The input device 29 includes a confirmation key 291 and multiple password keys 292 respectively formed on a plate (not numbered).

Figure 10:
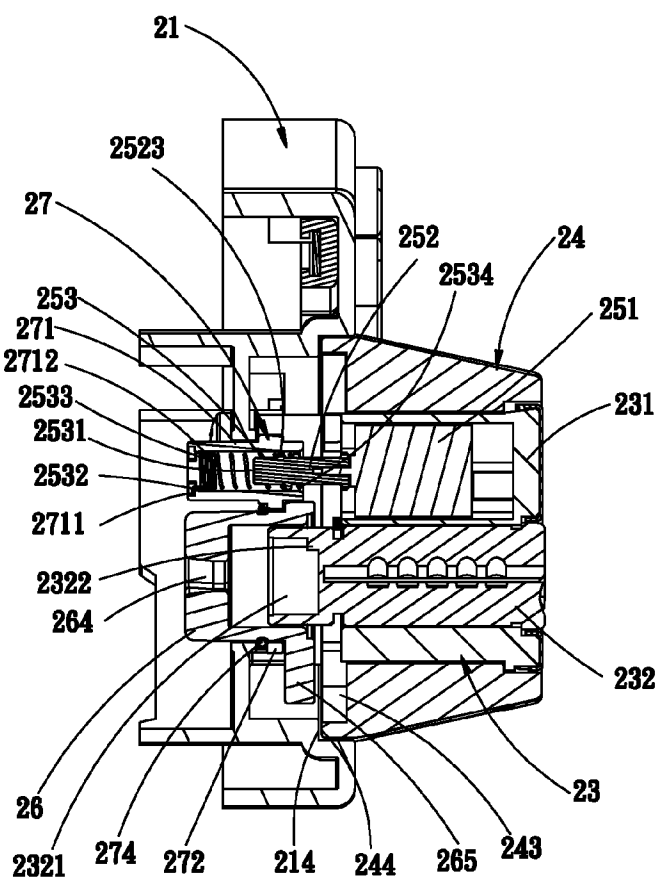
FIG. 10 is a cross sectional view showing that the ledge is removed from the operating element.
Figure 9:
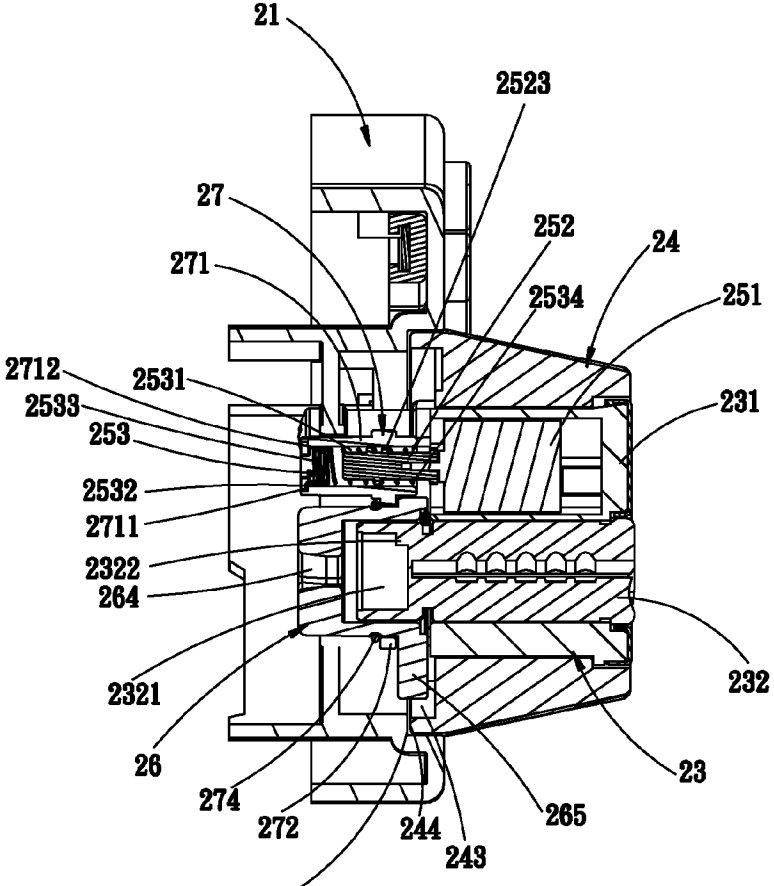
FIG. 9 is a cross sectional view showing that the ledge is received in one of paths of the operating element.
Figure 12:
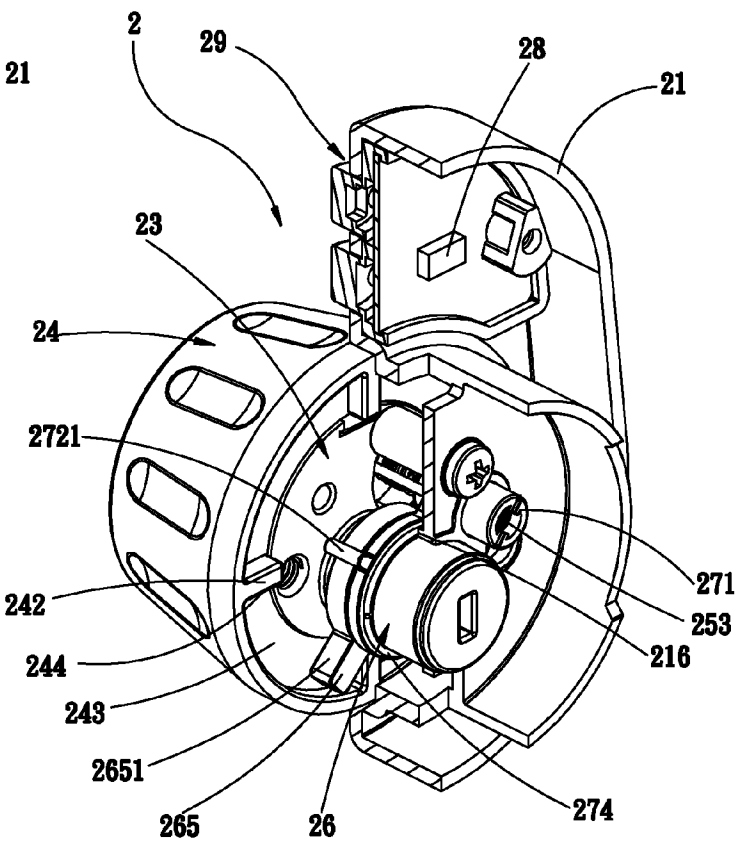
FIG. 12 is a perspective view showing that the ledge of the clutch device is free from interference by the operating element.
Figure 11:
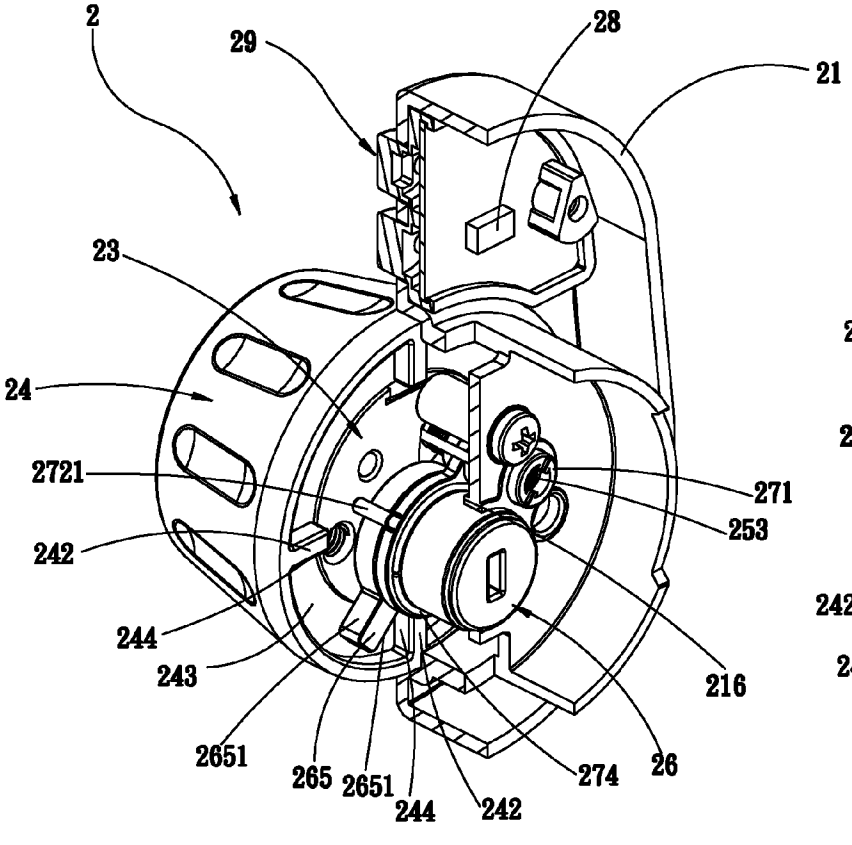
FIG. 11 is a perspective view showing that the ledge of the clutch device is received in one of the paths of the operating element so that the operating element is able to interact with the clutch device.
Figure 13:
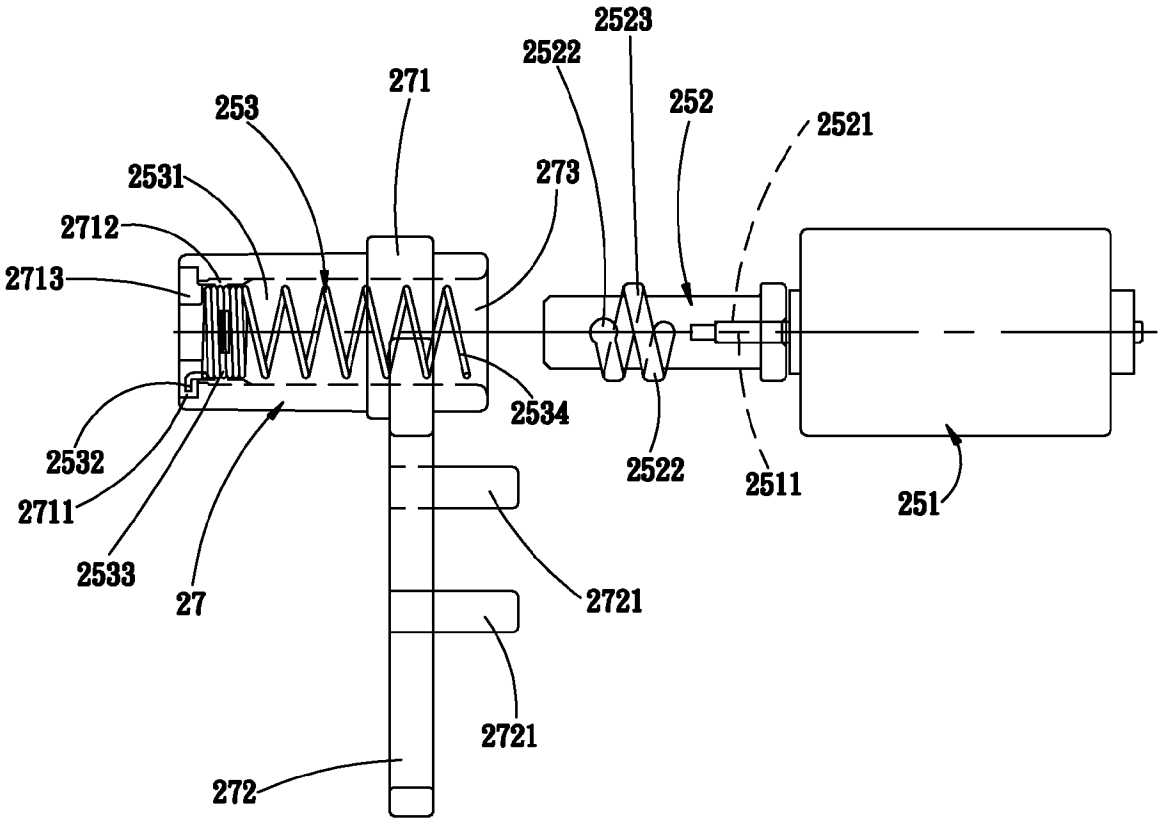
FIG. 13 is a schematic plan side view showing the mutual relationship between the motor and the transmission element.

The core assembly 23 includes a core housing 231 and a core 232 received in the core housing 231. The core housing 231 further includes a motor hole 2311, at least a pair of first screw holes 2312 defined in a back of the core housing 231, at least a pair of second screw holes 2313 adjacent to the at least one first pair of first screw holes 2312, a collar 2314 formed on a distal peripheral edge of the core housing 231. As described, the core 232 is received inside the core housing 231 and has one distal end thereof extending out of the core housing 231 connected by a securing ring 233 such that the core 232 is able to be rotatable relative to the core housing 231, a recess 2321 defined in the distal end of the core 232 and a step 2322 (as shown in FIGS. 9 and 10) formed on a bottom face defining the recess 2321.

The operating element 24 constructed in accordance with the preferred embodiment of the present invention is a truncated cone and has a centrally defined core assembly hole 241 to receive therein the core assembly 23, an annular collar 2411 formed on an inner face defining the core assembly hole 241 to mutually abut against the collar 2314 of the core assembly 23 to allow the operating element 24 to rotate relative to the core assembly 23, multiple driving parts 242 spatially formed on a bottom face of the annular collar 2411 and each driving part 242 providing a driving face 2421 formed on two opposite faces of the driving part 242, a path 243 defined between two driving parts 242 and a peripheral ring 244 formed on a peripheral edge of the annular collar 2411 to correspond to and abut against the skirt 214 of the base 21 to prevent separation of the operating element 24 from the base 21 in one direction and to allow the operating element 24 to be rotatable relative to the base 21

The driving device 25 includes a motor 251 received in the motor hole 2311 of the core assembly 23 and having a motor shaft 2511 extending out from the motor 251, a linkage 252 and a spring 253.

Figure 4:
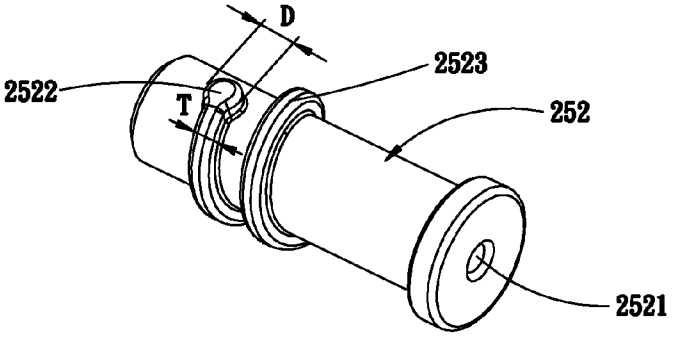
FIG. 4 is a perspective view of a linkage of a preferred embodiment of the transmission mechanism of the present invention.

With reference to FIG. 4, the linkage 252 has a centrally defined through hole 2521 to firmly receive therein the motor shaft 2511, a boss 2522 formed on a periphery thereof and a spiral 2523 securely formed and extending on the periphery thereof. It is noted that a diameter (D) of the boss 2522 is larger than a width (T) of the spiral 2523. The spring 253, preferably a spiral one, has a loose free end 2534 and a dense connecting portion 2533. The loose free end 2534 has a spiral channel 2531. A distal free end of the connecting portion 2533 is provided with a bent 2532.

The clutch device 26 is a sleeve like device and includes a first portion 261 and a second portion 262 having a diameter smaller than that of the first portion 261. The clutch device 26 has a central hole 263 defined to correspond to and receive therein a portion of the core 232, a rod hole 264 defined in a bottom face of the second portion 262, a ledge 265 integrally formed on an outer periphery of the first portion 261 to correspond to one of the paths 243 of the operating element 24 and having a driven face 2651 formed on two opposite side faces of the ledge 265 to correspond to the driving face 2421 of the operating element 24 and an annular groove 2621 defined in an outer periphery of the second portion 262

Figure 6:
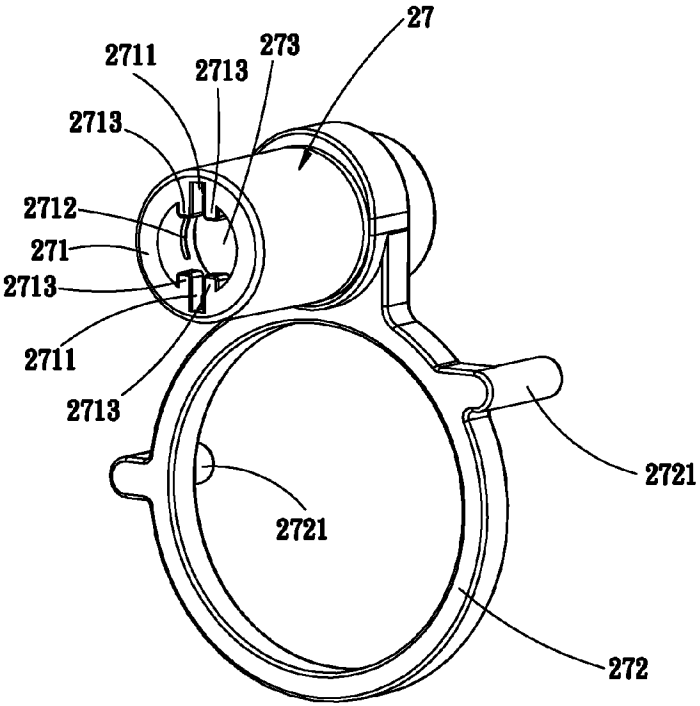
FIG. 6 is a perspective view of a transmission element of a preferred embodiment of the present invention.

With reference to FIG. 6, the transmission element 27 includes a tubular body 271 corresponding to the base plate second hole 2122 and a loop 272 securely formed on a periphery of the tubular body 271 to correspond to the second portion 262 of the clutch device 26. The tubular body 271 has a central path 273 defined to receive therein the spring 253. In addition to the central path 273, the tubular body 271 has a connection room 2712 formed in an inner face defining the central path 273 and having a diameter smaller than that of the central path 273 to correspond to the connecting portion of the spring 251, a pair of concaves 2711 defined in a peripheral edge of the connection room 2712 to correspond to and receive therein the bent 2532 of the spring 253, at least two pairs of connecting protrusions 2713 each formed to sandwich therebetween one of the two concaves 2711 to correspond to and securely connect to the connecting portion 2533 of the spring 253 and a lock ring 274 provided to correspond to the annular groove 2621 of the clutch device 26. The loop 272 is provided with multiple arms 2721 axially extending out toward the core assembly 23 to correspond to a sideface of the core housing 231. Due to the smaller diameter of provision of the connection room 2712 relative to the central path 273, after the connecting portion 2533 of the spring 253 is securely received inside the connection room 2712, the free end 2534 of the spring 253 is able to be pushed by the rotating spiral 2523.

A distal end of a rod 51 is extended into the recess 2321 of the core 232 to be controlled by the step 2322 and a securing ring 54 is applied to the rod 51 to secure the connection of the rod 51 to the core 232. The other distal end of the rod 51 is extended through the rod hole 264 of the clutch device 26. The rod hole 264 is constructed to mate with the shape of the distal end of the rod 51 such that after the distal end of the rod 51 is extended through the rod hole 264, the clutch device 26 is movable along with the rod 51.

When the first lock body 2 is to be assembled, the tubular body 271 of the transmission element 27 extends into the base plate second hole 2122 while the loop 272 receives the second portion 262 of the clutch device 26 with the lock ring 274 securely received in the annular groove 2621 of the second portion 262 of the clutch device 26 to secure the engagement between the transmission element 27 and the clutch device 26. Even though the lock ring 274 is applied to secure the engagement between the transmission element 27 and the clutch device 26, the clutch device 26 is still rotatable relative to the transmission element 27. After the engagement between the transmission element 27 and he clutch device 26 is completed, the tubular body 271 of the transmission element 27 is partially extended through the base plate second hole 2122 and the second portion 262 of the clutch device 26 is partially extended through the base plate first hole 2121 while having the ledge 265 to be receivable in one of the paths 243 of the operating element 24. Meanwhile, the arms 2721 are provided to abut against the periphery of the core housing 231 to prevent direct contact of the clutch device 26 with the core housing 231 and to enhance rotation of the operating element 24 relative to the core housing 231.

Figure 5:
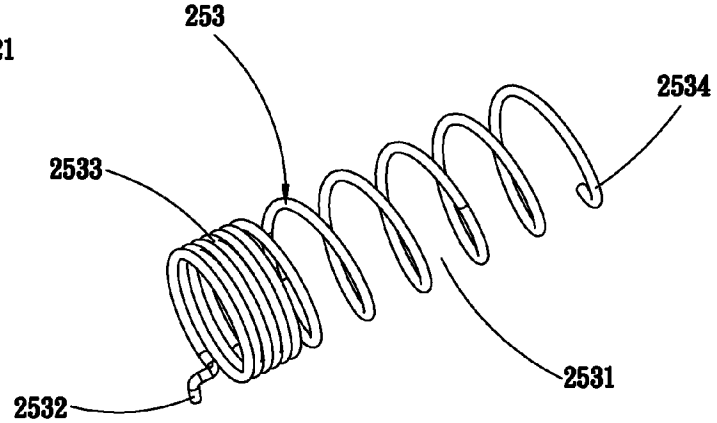
FIG. 5 is a perspective view showing a spring of one of the transmission mechanism of the preferred embodiment of the present invention.

Two screws 52 are applied to extend through the two support rod holes 2191 of the base 21 and into the first screw holes 2312 of the core assembly 23 to secure the engagement between the core assembly 23 and the base 21. In the meantime, the two support rods 219 of the base 21 are used to support the periphery of the core housing 231, the two first supports 217 are also used to support the periphery of the core housing 231 and the two second supports 218 are used to support the motor 251. Only after the first supports 217, the second supports 218 are used to support the core housing 231 and the motor 251 respectively, can the first lock body be formed into an integral body to function properly. Furthermore, it is to be noted that after the spring 253 is received in the tubular body 271 of the transmission element 27 and the linkage 252 is also received in the tubular body 271, the linkage 252 with the boss 2522 as well as the spiral 2523 is received in the spiral channel 2531 of the spring 253 (as shown in FIG. 5).

With reference to FIG. 7, a second lock body 4 constructed in accordance with the present invention includes a shell 41, a knob 42, a cam 43, a switch 44 and a power pack 46. The shell 41 has a shaft hole 411 defined there through, a receiving room 412 defined inside the shell 41 and securing holes 413. The knob 42 has a shaft 421 integrally extending outward therefrom to correspond to the shaft hole 411 of the shell 41 and having a recess 422 defined in a distal free end thereof to correspond to a distal free end of the rod 51. The cam 43 is constructed to have a hole (not numbered) to correspond to and receive therein the shaft 421 of the knob 42 and an engaging face 431 integrally formed therewith. Preferably, the hole of the cam 43 is so configured that after the shaft 421 of the knob 42 is extended therein, the shaft 421 is firmly and securely connected to the cam 43 such that the knob 42 is able to drive the cam 43 to move synchronously.

The switch 44, preferably a micro-switch, has a contact 441 so made to have resilience to correspond to the engaging face 431 of the cam 43. The power pack 46 is electrically connected to the switch 44 to provide electricity to the switch 44 such that after the contact 441 is depressed by the engaging face 431 of the cam 43, the switch 44 sends out a signal to be processed by the control unit 28. Two screws 53 are applied to extend through the two securing holes 413 and into the two second screw holes 2313 of the core assembly 23 of the first lock body 2 so as to combine the first lock body 2 and the second lock body 4 with the latch assembly 6 as shown in FIG. 1.

With reference to FIGS. 1, 2, 3 and 7, the input device 29 may be remotely controlled or provided with keys. In this preferred embodiment of the present invention, the first lock body 2 is provided on one side of a door and the second lock body 4 is provided on the other side of the door while the latch 61 of the latch assembly 6 is extendable to selectively lock the door.

As previously described, as the rod 51 being controlled by the core 232 to manipulate the extension or retraction of the latch 61 is substantially the same as the conventional procedure, detailed description thereof is therefore omitted for concise and prevention of any confusion.

With reference to FIGS. 1-3, 8-13, after the first lock body 2 and the second lock body 4 are combined with the assistance of the first screws 52 and the second screws 53, an operator is able to use the input device 29 to control movement of the latch 61. Taking the situation where the latch 61 is retracted inside the latch assembly 6 for example, the operator may use the password keys 292 to key-in a correct combination password. After the key-in process, the confirmation key 291 may be pressed to confirm the number so input. After confirmation key 291 is pressed, the control unit 28 is initiated to send a signal to activate operation of the control unit 28, which sequentially sends a signal to activate operation of the motor 251. The rotation of the motor shaft 2511 which firmly extends into the through hole 2521 drives the linkage 252 to simultaneously rotate. Further, because the boss 2522 and the spiral 2523 are received in the spiral channel 2531 of the spring 253, the rotation of the motor 251 causes the spring 253 to be moved linearly with assistance of the rotation of the linkage 252 to further drive the movement of the transmission element 27. Still further, as the connecting portion 2533 of the spring 253 is firmly received inside the connection room 2712 of the transmission element 27 and the loop 272 firmly receives therein the second portion 262 of the clutch device 26, the rotation of the linkage 252 drives the transmission element 27, the spring 253 as well as the clutch device 26 to move linearly. While the clutch device 26 is moved linearly, the ledge 265 is then selectively moved into or away from one of the paths 243 of the operating element 24 such that when the ledge 265 is received in one of the paths 243, the operating element 24 is able to optionally control the rotation of the clutch device 26. The rotation of the clutch device 26 drives the rotation of the rod 51 and, consequently, the latch 61 of the latch assembly 6 is able to be extended or retracted.

In another word, when the latch 61 is retracted inside the latch assembly 6 and the ledge 265 of the clutch device 26 is received in one of the paths 243 of the operating element 24 as a result of the driving of the motor 251, the operator may use the operating element 24 to extend the latch 61 out of the latch assembly 6. On the other hand, when the ledge 265 is away from any one of the paths 243, the operator may not use the operating element 24 to unlock the door.

It is to be noted that after the confirmation key 291 is pressed, the control unit 28 sends a control signal to control the operation of the motor 251. After the motor 251 is activated and the ledge 265 is driven to be received inside one of the paths 243, the control unit 28 provides a lag time to the motor 251 so that the operator may use the operating element 24 to move the latch 61. In the meantime, while the ledge 265 of the clutch device 26 is moving directly toward one of the driving parts 242 to engage with one of the driving parts 242, but not one of the paths 243, the continuous rotation of the motor shaft 2511 drives the linkage 252 to rotate continuously, which consequently deform the spring 253 to allow an accumulating resilience of the deformed spring to push the ledge 2651 away from the driving part 242 and be received in one of the paths 243 when the operating element 24 is rotated by the operator. That is, the driving face 2421 of the driving part 242 drives the driven face 2651 of the ledge 265 to consequently extend the latch 61.

After the latch 61 is driven due to the driving force from the rod 51, the rod indirectly drives the cam 43 to move to allow the engaging face of the cam 43 to engage with the contact 441 of the switch 44, which inevitably sends out a signal to the control unit 28. After the control unit 28 receives the signal sent from the switch 44, the control unit 28 sends out a control signal to the motor 251 to control the motor 251 to rotate in a direction opposite to that applied in driving the ledge 265 into one of the paths 243, such that the ledge 265 is away from the paths 243 of the operating element 24, any movement of the operating element 24 has no influence to the latch 61. That is, when the driving face 2651 of the ledge 265 is away from engagement with the driving face 2421 of the driving part 242, rotation of the operating element 24 has no effect to the ledge 265.

It is to be noted that when the latch 61 is extended outside the latch assembly 6, i.e., the engaging face 431 of the cam 43 is free from engagement with the contract 441 of the switch 44, after the motor 251 is activated due to the result of correct input of the combination to the input device 29 and the press of the confirmation key 291, the rotation of the linkage 252, with the assistance of the rotation of the motor shaft 2511, drives the transmission element 27 as well as the clutch device 26 to move linearly such that the ledge 265 of the clutch device 26 moves toward one of the paths 243 of the operating element 24 to allow the operating element 24 to control the movement of the latch 61 of the latch assembly 6.

As previously described, the lag time previously provided by the control unit 28 is 5 seconds. That is, during the predetermined time period, if there is no signal sent by the switch 44 to stop timing, the control unit 28 will automatically send a control signal to control the motor 251 to rotate reversely, which drives the ledge 265 of the clutch device 26 to move away from one of the paths 243. As there is no engagement between the driving face 2421 of the driving part 242 and the driven face 2651 of the ledge 265, any rotation of the operating element 24 has no effect to the clutch device 26.

Further, if a proper key (not shown and numbered) is inserted into the core 232, the step 2322 formed inside the recess 2321 of the core 232 is able to drive the rod 51 to move the latch 61 of the latch assembly 6.

Many changes and modifications in the above described embodiment of the invention can, of course, be carried out without departing from the scope thereof. Accordingly, to promote the progress in science and the useful arts, the invention is disclosed and is intended to be limited only by the scope of the invention.

What is claimed is:

1. A transmission mechanism of a lock assembly having a rod operably connected to a latch to control movement of the latch, the transmission mechanism comprising:

a base;

a core assembly partially received in the base and having therein a core adapted to connect to the rod so as to control movement of the rod;

an operating element rotatably connected to the base;

a clutch device movably received in the base and selectively engaged with the operating element;

a driving device received in the core assembly to drive the clutch device to move toward/away from the operating element; and an activation device connected to the base to control operation of the driving device such that the latch is moved with assistance of the rotation of the operating element when the clutch device is connected to the operating element and the latch is immovable when the clutch device is away from engagement with the operating element;

wherein the driving device and the clutch device are non-coaxially arranged and parallel to each other; and wherein the core can be driven by inserting a key therein, such that the core is connected to the rod to control movement of the rod.

2. The transmission mechanism as claimed in claim 1, wherein the driving device is a motor received in the core assembly and connected to the clutch device such that rotation of the motor drives the clutch device to move linearly.

3. The transmission mechanism as claimed in claim 1, wherein the driving device has a motor connected to the clutch device such that rotation of the motor drives the clutch device to move linearly.

4. The transmission mechanism as claimed in claim 1, further comprising a transmission element including a tubular body to partially connect the driving device and a loop integrally formed with the tubular body to connect to the clutch device so that the driving device is able to drive the clutch device to move relative to the operating element.

5. The transmission mechanism as claimed in claim 4, further comprising a linkage firmly connected to the motor and having thereon a spiral and a spring mounted around the linkage and having the spiral received in a spiral channel of the spring so that the driving of the driving device drives the spring.

6. The transmission mechanism as claimed in claim 5, wherein the linkage has a boss firmly formed on a periphery thereof and received in the spiral channel.

7. The transmission mechanism as claimed in claim 4, wherein the operating element has a centrally defined core assembly hole to receive therein the core assembly, an annular collar formed to mutually abut against the core assembly to allow the operating element to rotate relative to the core assembly, multiple driving parts spatially formed on a bottom face of the annular collar and a path defined between two adjacent driving parts, the clutch device has a ledge securely extended away therefrom to be selectively received in the path and a rod hole defined to adapt to receive the rod such that when the ledge is received in the path, rotation of the operating element drives the rod to rotate and when the ledge is away from the path, the clutch device is free from influence of the operating element.

8. The transmission mechanism as claimed in claim 5, wherein the operating element has a centrally defined core assembly hole to receive therein the core assembly, an annular collar formed to mutually abut against the core assembly to allow the operating element to rotate relative to the core assembly, multiple driving parts spatially formed on a bottom face of the annular collar and a path defined between two adjacent driving parts, the clutch device has a ledge securely extended away therefrom to be selectively received in the path and a rod hole defined to adapt to receive the rod such that when the ledge is received in the path, rotation of the operating element drives the rod to rotate and when the ledge is away from the path, the clutch device is free from influence of the operating element.

9. The transmission mechanism as claimed in claim 6, wherein the operating element has a centrally defined core assembly hole to receive therein the core assembly, an annular collar formed to mutually abut against the core assembly to allow the operating element to rotate relative to the core assembly, multiple driving parts spatially formed on a bottom face of the annular collar and a path defined between two adjacent driving parts, the clutch device has a ledge securely extended away therefrom to be selectively received in the path and a rod hole defined to adapt to receive the rod such that when the ledge is received in the path, rotation of the operating element drives the rod to rotate and when the ledge is away from the path, the clutch device is free from influence of the operating element.

10. The transmission mechanism as claimed in claim 7, wherein the activation device includes an input device mounted on the base to provide a combination to selectively establish a link with the motor and a control unit connected to the base to receive a signal sent by the input device and send a corresponding signal to the motor to control rotational direction of the motor.

11. The transmission mechanism as claimed in claim 10, wherein the activation device includes an input device mounted on the base to provide a combination to selectively establish a link with the motor, a control unit connected to the base to receive a signal sent by the input device and send a corresponding signal to the motor to control rotational direction of the motor and a switch electrically connected to the control unit to send a signal to the control unit in a situation where the switch is activated so as to reverse the rotational direction of the motor.

12. A transmission mechanism of a lock assembly having a rod operably connected to a latch to control movement of the latch, the transmission mechanism comprising:

a base;

a core assembly partially received in the base and having therein a core adapted to connect to the rod so as to control movement of the rod;

an operating element rotatably connected to the base;

a clutch device movably received in the base and selectively engaged with the operating element;

a driving device received in the core assembly to drive the clutch device to move toward/away from the operating element; and an activation device connected to the base to control operation of the driving device such that the latch is moved with assistance of the rotation of the operating element when the clutch device is connected to the operating element and the latch is immovable when the clutch device is away from engagement with the operating element, wherein the activation device is able to automatically drive the driving device to cause the clutch device to disengage from the operating element after the clutch device engages with the operating element for a predetermined time, and wherein the driving device and the clutch device are non-coaxially arranged and parallel to each other; and wherein the core can be driven by inserting a key therein, such that the core is connected to the rod to control movement of the rod.

13. The transmission mechanism as claimed in claim 12, wherein the activation device includes an input device securely mounted on the base to provide a combination to selectively establish a link with the motor and a control unit connected to the base to receive a signal sent by the input device and send a corresponding signal to the motor to control rotational direction of the motor.

14. The transmission mechanism as claimed in claim 13, wherein the activation device includes the input device securely mounted on the base to provide the combination to selectively establish the link with the motor, the control unit connected to the base to receive the signal sent by the input device and send the corresponding signal to the motor to control rotational direction of the motor and a switch electrically connected to the control unit to send a signal to the control unit in a situation where the switch is activated so as to reverse the rotational direction of the motor.

15. A transmission mechanism of a lock assembly having a rod operably connected to a latch to control movement of the latch, the transmission mechanism comprising:

a base;

a core assembly securely received in the base and having a core housing and a core received therein the core housing to adapted to connect to the rod so as to control movement of the rod;

an operating element rotatably received in the base;

a clutch device movably received in the base and selectively engaged with the operating element;

a motor securely received in the core housing to drive the clutch device to move toward/away from the operating element; and an activation device securely connected to the base to control operation of the motor such that the latch is moved with assistance of the rotation of the operating element when the clutch device is connected to the operating element and the latch is immovable when the clutch device is away from engagement with the operating element, wherein the motor and the clutch device are non-coaxially arranged and parallel to each other; and wherein the core can be driven by inserting a key therein, such that the core is connected to the rod to control movement of the rod.

16. The transmission mechanism as claimed in claim 15, wherein the motor is connected to the clutch device such that rotation of the motor drives the clutch device to move linearly.

17. The transmission mechanism as claimed in claim 15 further comprising a transmission element including a tubular body to partially connect the motor and a loop integrally formed with the tubular body to connect to the clutch device so that the motor is able to drive the clutch device to move relative to the operating element.

18. The transmission mechanism as claimed in claim 17, further comprising a linkage firmly connected to the motor and having thereon a spiral and a spring mounted around the linkage and having the spiral received in a spiral channel of the spring so that the driving of the motor drives the spring.

19. The transmission mechanism as claimed in claim 18, wherein the linkage has a boss firmly formed on a periphery thereof and received in the spiral channel.

20. The transmission mechanism as claimed in claim 19, wherein the activation device includes an input device securely mounted on the base to provide a combination to selectively establish a link with the motor and a control unit connected to the base to receive a signal sent by the input device and send a corresponding signal to the motor to control rotational direction of the motor.

21. The transmission mechanism as claimed in claim 20, wherein the activation device includes an input device securely mounted on the base to provide a combination to selectively establish a link with the motor, a control unit connected to the base to receive a signal sent by the input device and send a corresponding signal to the motor to control rotational direction of the motor and a switch electrically connected to the control unit to send a signal to the control unit in a situation where the switch is activated so as to reverse the rotational direction of the motor.

* * * * *